US007386450B1

(12) United States Patent
Baumgartner et al.

(10) Patent No.: US 7,386,450 B1
(45) Date of Patent: Jun. 10, 2008

(54) GENERATING MULTIMEDIA INFORMATION FROM TEXT INFORMATION USING CUSTOMIZED DICTIONARIES

(75) Inventors: Jason Raymond Baumgartner, Austin, TX (US); Nadeem Malik, Austin, TX (US); Steven Leonard Roberts, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 1053 days.

(21) Appl. No.: 09/460,832

(22) Filed: Dec. 14, 1999

(51) Int. Cl.
*G10L 13/08* (2006.01)

(52) U.S. Cl. ..... 704/260; 704/258; 704/270

(58) Field of Classification Search ..... 704/260, 704/258, 267, 243, 270
See application file for complete search history.

(56) References Cited

U.S. PATENT DOCUMENTS 4,979,216 A * 12/1990 Malsheen et al. ..... 704/260
5,384,893 A * 1/1995 Hutchins ..... 704/267
5,717,827 A * 2/1998 Narayan ..... 704/260
5,774,854 A * 6/1998 Sharman ..... 704/260
5,850,629 A * 12/1998 Holm et al. ..... 704/260
5,878,393 A * 3/1999 Hata et al. ..... 704/260
5,924,068 A * 7/1999 Richard et al. ..... 704/260
6,081,780 A * 6/2000 Lumelsky ..... 704/260
6,122,616 A * 9/2000 Henton ..... 704/258
6,243,676 B1 * 6/2001 Witteman ..... 704/243
6,250,928 B1 * 6/2001 Poggio et al. ..... 434/185
6,260,016 B1 * 7/2001 Holm et al. ..... 704/260

* cited by examiner

*Primary Examiner*—Richemond Dorvil
*Assistant Examiner*—Qi Han
(74) *Attorney, Agent, or Firm*—Duke W. Yee; Gregory Dovdikoff; Peter B. Manzo

(57) ABSTRACT

A system for generating multimedia information including audio information, video information, or both is disclosed. The system includes an interface, a text converter, and a first multimedia dictionary. The interface is suitable for receiving a text-based message, such as an email message, from a transmission medium, such as the internet. The text converter is configured to receive the text-based message from the interface. The converter is adapted to decompose the words of the text-based message into their component diphthongs. The first multimedia dictionary receives a diphthong produced by the text converter and produces a set of digitized samples of multimedia information representative of the received diphthong. The system may include a second multimedia dictionary containing its own set of digitized samples. In this embodiment, the system is configured to determine the author of the text-based message and, in response, to select between the first and second multimedia dictionaries.

2 Claims, 5 Drawing Sheets

GENERATING MULTIMEDIA INFORMATION FROM TEXT INFORMATION USING CUSTOMIZED DICTIONARIES

BACKGROUND

1. Field of the Present Invention

The present invention generally relates to the field of multimedia and more particularly to a system for transforming text-based information to audio or audio-video information.

2. History of Related Art

Multimedia presentations are prevalent in a variety of applications including, as just one example, internet applications. The success of many of these applications is largely-based on the realism achieved by the application. Many applications, including email applications, generate text-based information that users might prefer to receive as a multimedia message. (For purposes of this disclosure, a multimedia message refers to an audio message, a video message, or a message containing audio and video). One approach to achieving multimedia messages uses sampled human speech. Drawbacks of this approach include the requirement that the information must be read by a human. In addition, the size (in terms of bytes of information) of a sampled segment of speech, even with sophisticated pause detection and other tricks, is typically relatively large (especially if video information is incorporated into the transmitted information). These large multimedia bit streams frequently must be transmitted over bandwidth starved mediums such as the internet, often resulting in unacceptably low transmission rates that can lead to in poor quality at the receiving end and undesirable delay times. In addition, the capacity of the most commonly used transmission mediums is growing at a much lower rate than the demand. Consequently, there exists a tremendous need for low-bandwidth, low-storage systems capable of producing or emulating high-resolution audio-visual transmission at real-time speeds. The transmission of even compressed samples of multimedia information often consumes excessive bandwidth. Accordingly, it would be highly desirable to implement a solution that enabled a system capable of transmitting a limited amount of data representative of text-based information over a transmission bandwidth and processing the data locally to create a realistic and personalized audio or audio-video stream from the text-based information.

SUMMARY OF THE INVENTION

The identified problems are addressed by a system for generating multimedia information including audio information, video information, or both according to the present invention. The system includes an interface, a text converter, and a first multimedia dictionary. The interface is suitable for receiving a text-based message, such as an email message, from a transmission medium, such as the internet. The text converter is configured to receive the text-based message from the interface. The converter is adapted to decompose the words of the text-based message into their component diphthongs. The first multimedia dictionary receives a diphthong produced by the text converter and produces a set of digitized samples of multimedia information representative of the received diphthong. The multimedia dictionary may include a set of entries where each entry comprises a tag and a corresponding set of digitized multimedia samples. In this embodiment, the received diphthong is used to index the tags. The multimedia dictionary then retrieves the set of digitized multimedia samples corresponding to the entry with a tag that matches the received diphthong. The multimedia dictionary may include a first dictionary block and a second dictionary block. The first dictionary block is configured to receive a diphthong produced by the text converter and, in response, to retrieve a set of intermediate values. The second dictionary block is configured to receive the set of intermediate values and to retrieve a corresponding set of digitized multimedia samples. The system may include a digital-to-analog converter configured to receive the set of digitized samples from the multimedia dictionary and a multimedia output device configured to receive a multimedia signal from the digital-to-analog converter. The system may include a second multimedia dictionary containing its own set of digitized samples. In this embodiment, the system is configured to determine the author of the text-based message and, in response, to select between the first and second multimedia dictionaries. The first dictionary may be representative of the speech of a first speaker and the second dictionary may be representative of the speech of a second speaker. The first dictionary may be selected if the first speaker is the author of the text-based message.

The invention further contemplates a method of generating multimedia information by decomposing a text-based message, such as an email message, into a set of diphthongs and indexing a multimedia dictionary with each of the set of diphthongs to retrieve a set of digitized multimedia samples for each diphthong. Each set of digitized multimedia samples is a digital representation of its corresponding diphthong. The digitized multimedia samples may be converted to multimedia signals suitable for playing on a multimedia output device. In one embodiment, the decomposing of the text-based message includes matching each word in the message with an entry in a diphthong data base and retrieving a set of diphthongs contained in the matching entry. In one embodiment, the text-based message is transmitted over and received from a bandwidth limited transmission medium such as the internet. The multimedia dictionary may include a set of entries where each entry includes a tag and a corresponding set of digitized samples. Indexing the multimedia dictionary may include matching a diphthong with one of the tags and retrieving the corresponding set of digitized samples. The multimedia dictionary may include a first dictionary block and a second dictionary block as indicated previously. In this embodiment, indexing the multimedia dictionary includes matching the diphthong with a tag in the first dictionary block to retrieve the corresponding set of intermediate values and matching each retrieved intermediate value with a tag in the second dictionary block to retrieve the corresponding set of digitized samples. The method may further include selecting between a first multimedia dictionary and a second multimedia dictionary. In this embodiment, the first dictionary may contain a first set of digitized multimedia samples corresponding to each diphthong and the second dictionary may contain a second set of digitized multimedia samples corresponding to each diphthong. The selection between the first and second multimedia dictionaries may depend on determining an author of the text-based message. In one embodiment, the first multimedia dictionary is selected if a first speaker is determined as the author of the text-based message and the digitized samples in the first dictionary comprise digital representations of the first speaker speaking the corresponding diphthong. In addition, the digitized samples may include video information comprising digital representations of a video image of the first speaker speaking the corresponding diphthong.

BRIEF DESCRIPTION OF THE DRAWINGS

Other objects and advantages of the invention will become apparent upon reading the following detailed description and upon reference to the accompanying drawings in which.

Figure 1:
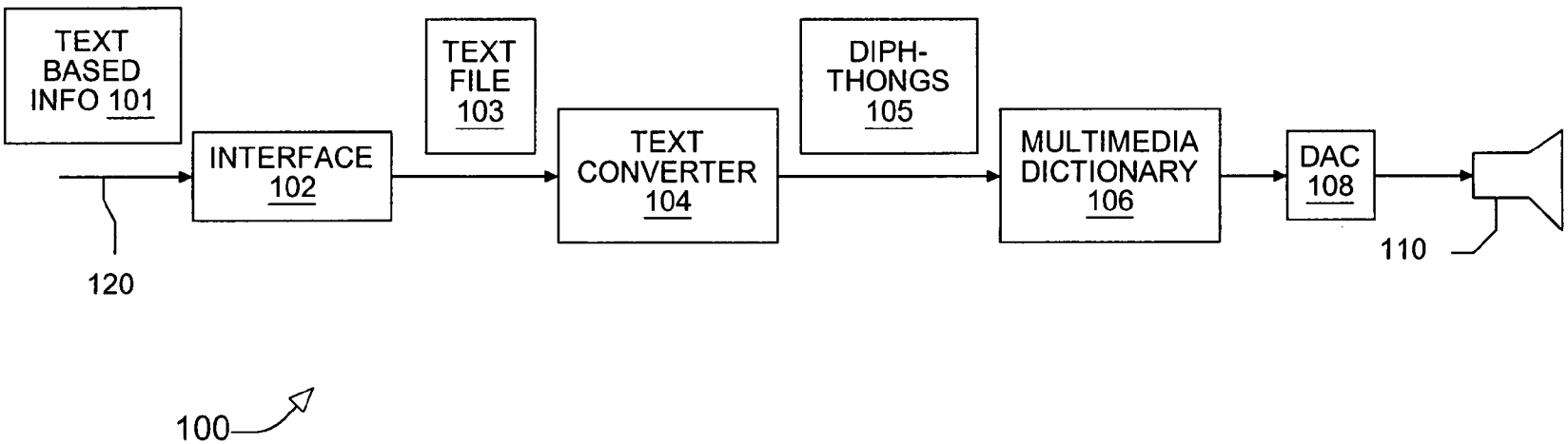
FIG. 1 is a block diagram of a system for generating audio-video information according to one embodiment of the invention.

While the invention is susceptible to various modifications and alternative forms, specific embodiments thereof are shown by way of example in the drawings and will herein be described in detail. It should be understood, however, that the drawings and detailed description presented herein are not intended to limit the invention to the particular embodiment disclosed, but on the contrary, the intention is to cover all modifications, equivalents, and alternatives falling within the spirit and scope of the present invention as defined by the appended claims.

DETAILED DESCRIPTION OF THE DRAWINGS

Turning now to the drawings, FIG. 1 illustrates selected components of a system 100 for converting text-based information to audio or audio-video information according to one embodiment of the invention. As depicted in FIG. 1, system 100 includes an interface unit 102, a text converter 104, a dictionary 106, a digital-to-analog converter (DAC) 108, and an output device such as a speaker 110. In embodiments supporting conversion of text-based information to audio-video information, system 100 would further include a suitable video output device such as a display monitor.

Figure 2:
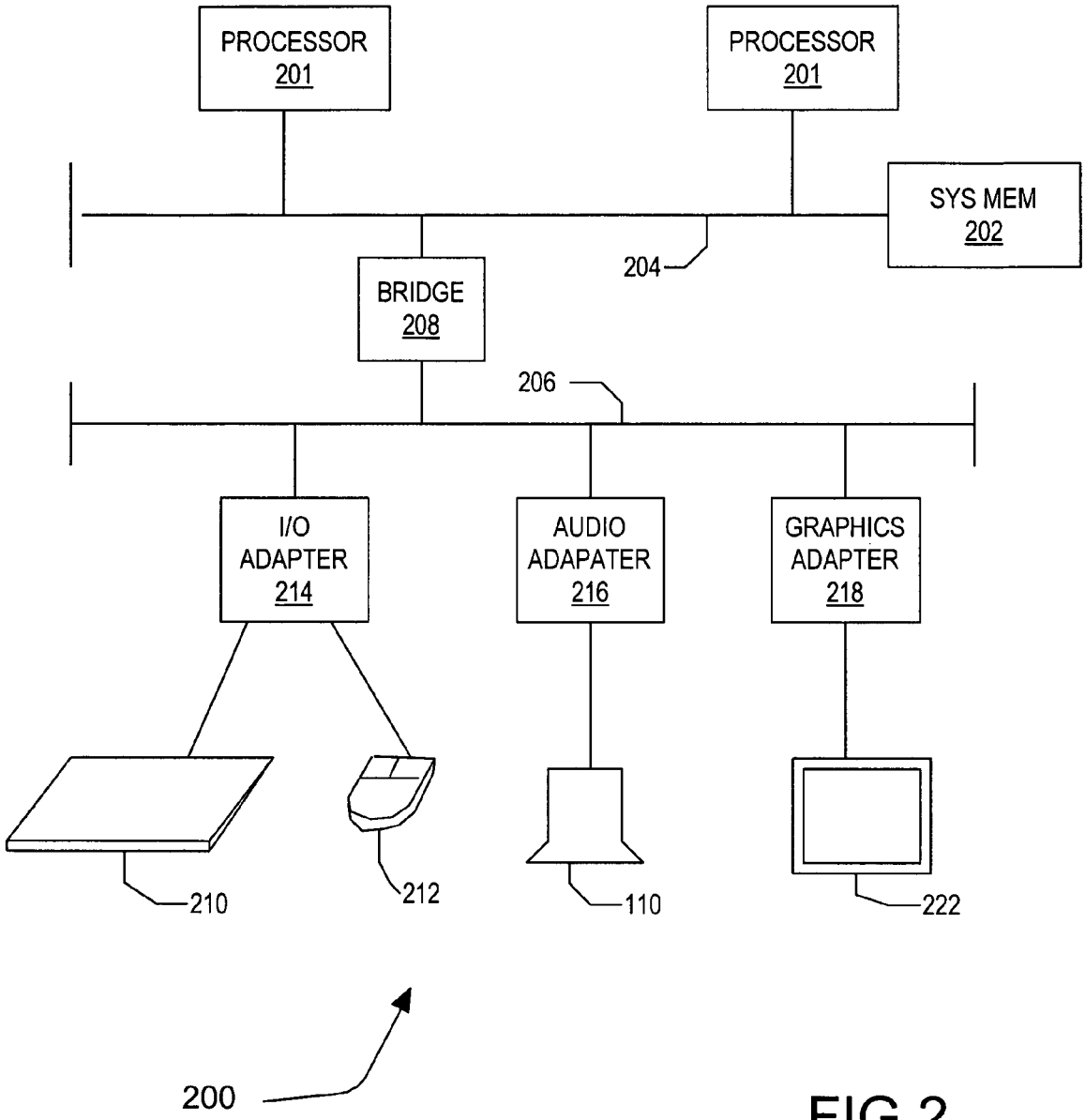
FIG. 2 is a block diagram of a computing device suitable for implementing the system of FIG. 1.

In one embodiment, a properly configured microprocessor-based computing device may be used to implement system 100. Turning momentarily to FIG. 2, selected components of such a computing device are indicated by reference numeral 200. In the depicted embodiment, computing device 200 includes one or more processors 201 connected to a system memory 202 via a system bus 204. Any of a variety of commercially distributed microprocessors may be used as processors 201 including, as examples, PowerPC® processors from IBM Corporation, Sparc® Microprocessors from Sun Microsystems, and x86 compatible microprocessors such as Pentium® processors from Intel Corporation and Athlon® processors from Advanced Micro Devices. Computing device 200 may further include one or more bridges 208 for providing communication between system bus 204 and a peripheral bus 206. The one or more peripheral busses 206 may be compliant with industry standard peripheral busses including, as examples, the Industry Standard Architecture (ISA), the Extended Industry Standard Architecture (EISA), the Accelerated Graphics Port (AGP), and the Peripheral Component Interface (PCI) as specified in the PCI Local Bus Specification Rev. 2.2 available from the PCI Special Interest Group at www.pcisig.org and incorporated by reference herein. The depicted embodiment of computing device 200 further includes suitable input devices such as keyboard 210 and pointing device 212 connected to peripheral bus 206 via an I/O adapter 214. Computing device 200 may further include output devices including speaker 110 connected to peripheral bus 206 via audio adapter 216 and a display device 222 connected to peripheral bus 222 via a graphics adapter 218. Portions of system 100 may be implemented as a set of instructions stored on a computer readable medium such as system memory 202 of computer device 200, a hard disk, floppy disk, CD ROM, magnetic tape, or other storage facility. In this implementation, the set of computer instructions are suitable for execution by processor(s) 201 of system 200 or by another suitable processor or controller.

Returning now to FIG. 1, interface unit 102 is configured to receive text-based information 101 via a transmission medium 120. In embodiments where system 100 is implemented with computing device 200, interface 102 may represent a modem that connects computing device 200 with an external transmission medium 120 such as the internet, or a network adapter that connects computing device 200 with one or more other computing devices. In one application, text-based information 101 may comprise an email message sent via the internet from an originator (author) to a recipient. It is to be understood however, that the invention is intended to be generally applicable to all forms of text-based information. Interface unit 102 may convert text-based information 101 to a format suitable for use by system 100. As an example, text-based information 101 may be transmitted over transmission medium 120 as serial data and interface unit 102 may convert the received serial data to parallel data. The output of interface unit (referred to herein as text file 103), is provided to a text converter 104. Text file 103 may comprise, for example, a conventional ASCII text file, which will be familiar to those in the field of microprocessor-based computer systems.

Figure 5:
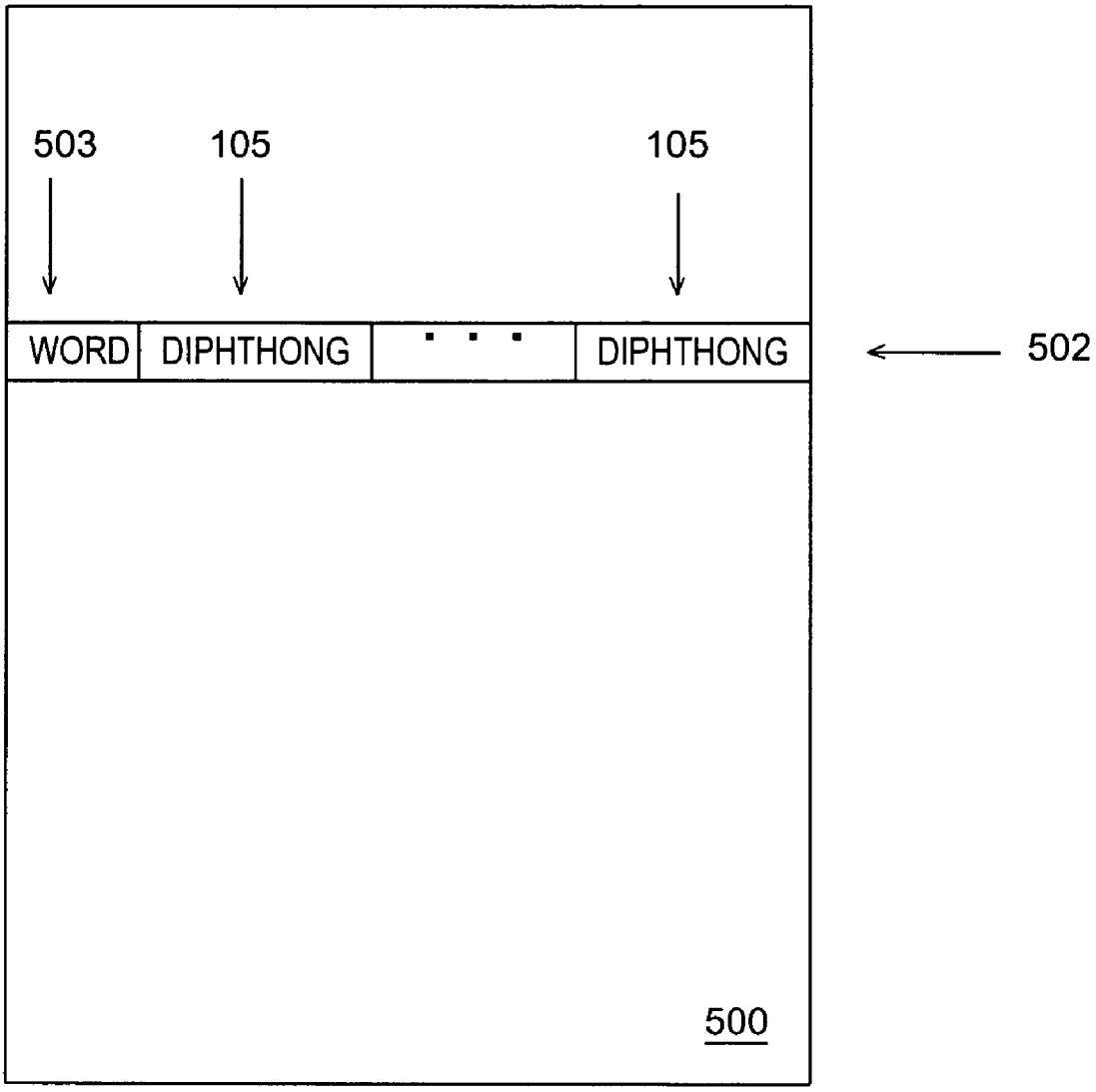
FIG. 5 is a block diagram of a text converter suitable for use in the system of FIG. 1 according to one embodiment of the invention.

Text converter 104 is suitable for analyzing the words contained in text file 103 and decomposing the words into a set of monosyllabic speech sounds referred to herein as diphthongs. All words in a spoken language are formed as a combination of these speech sounds or diphthongs. The number of diphthongs required to form the vast majority of words used in spoken languages, such as English, is relatively small thereby enabling the creation of a very large number of words from a relatively small number of diphthongs. In one embodiment, text converter 104 may utilize an exact approach. In an exact approach, text converter 104 compares each word in text file 103 to the contents of a diphthong database in which the diphthong components of each word are stored. The diphthong database, an example of which is depicted in FIG. 5 and represented by reference numeral 500, includes a set of entries 502. Each entry includes a tag 503 and a corresponding set of diphthongs 105. Text converter 104 uses words in text file 103 to index diphthong database 500 and retrieve the set of diphthongs 105 in the entry 502 with a tag 503 that matches the received word. In one embodiment, each diphthong may be represented by a simple integer value. This exact approach to text converter 104 could be implemented in a fashion substantially similar to the manner in which standard word dictionaries include a pronunciation key for each entry. Such pronunciation keys typically indicate the diphthong components of each word in addition to indicating accentuation information.

As an alternative to the exact approach, which may require substantial memory to store diphthong database 500, a heuristic approach to text converter 104 could be initiated with a relatively small set of words for which the component diphthongs are known. As converter 104 receives words that it has not previously encountered, the diphthong patterns of the existing words are used to make an informed prediction about the diphthong components of new words. In this manner, the heuristic implementation of text converter 104 will "learn" new words over time and develop its own vocabulary. In either embodiment, text converter 104 decomposes the text file 103 into its component diphthongs and routes the diphthongs to a multimedia dictionary 106.

Figure 3:
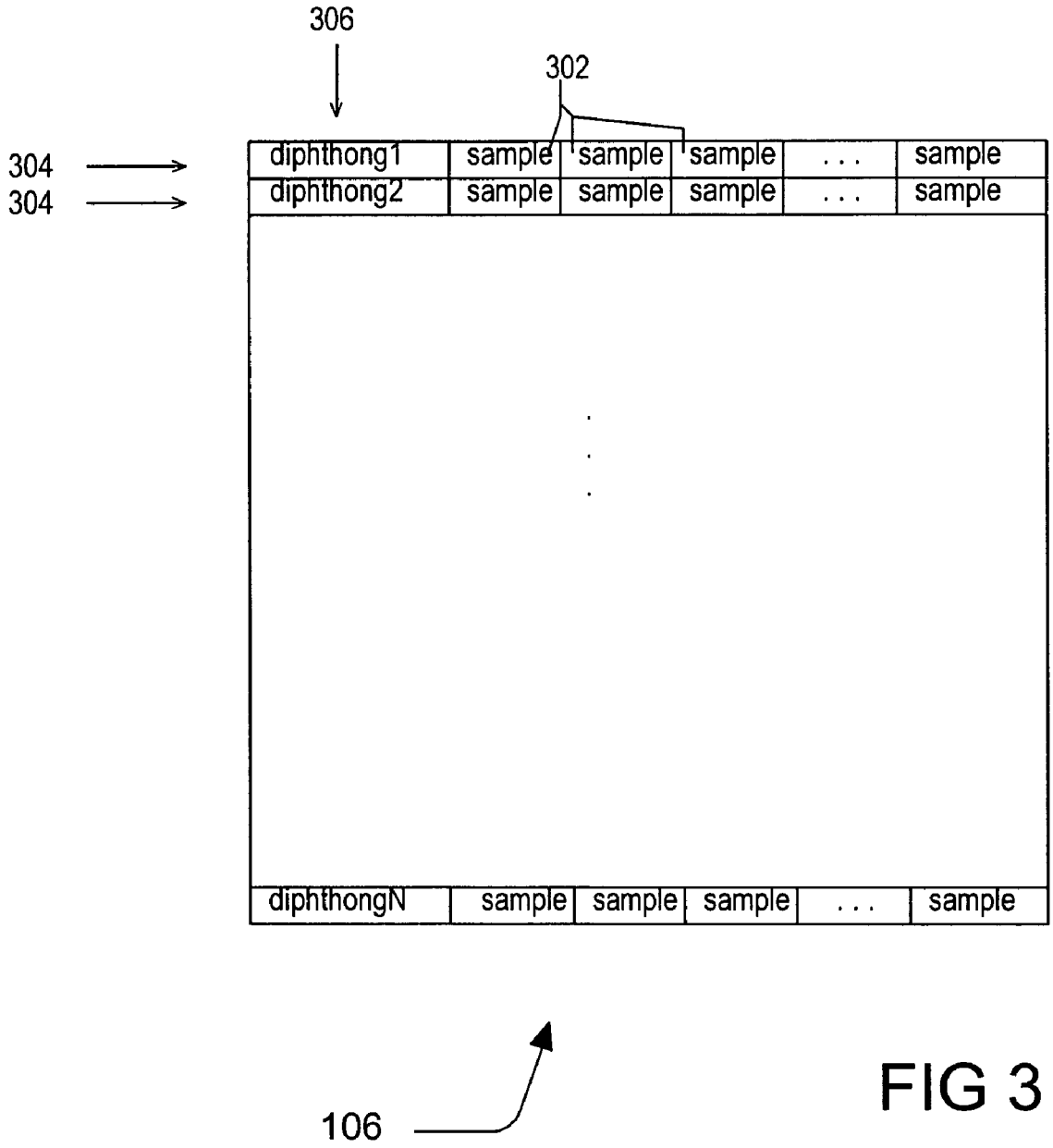
FIG. 3 is a block diagram of an audio dictionary according to one embodiment of the invention.

The output of text converter 104 is a set of diphthongs indicated in FIG. 1 by reference numeral 105. The set of diphthongs 105, which is indicative of the original text-based information 101, is provided to a multimedia dictionary 106. Multimedia dictionary 106 is preferably implemented as an indexable database containing a set of digitized multimedia samples. Preferably, each multimedia sample or set of multimedia samples retrieved by multimedia dictionary 106 corresponds to a diphthong. As multimedia dictionary 106 receives the set of diphthongs 105 from text converter 104, the received diphthongs are used to index an entry in multimedia dictionary 106. One embodiment of a multimedia dictionary 106 suitable for use in the present invention is depicted in FIG. 3. In this embodiment, multimedia dictionary 106 includes a set of entries 304. Each entry 304 includes a tag 306 and a corresponding set of digitized multimedia samples 302. When a diphthong in the set of diphthongs 105 is received from text converter 104, it is compared with the tags 306 stored in dictionary 106. The set of multimedia samples 302 corresponding to the tag field 306 matching the diphthong value is retrieved from dictionary 106. Each sample 302 may comprise one or more 8-bit or 16-bit audio or audio-video samples representing a portion of a diphthong. In the case of audio samples, each of the samples 302 may represent the instantaneous sounds used to form the corresponding diphthong. In the case of audio-video samples 302, each sample 302 may represent the instantaneous sound and image of a person speaking the corresponding diphthong.

Figure 4:
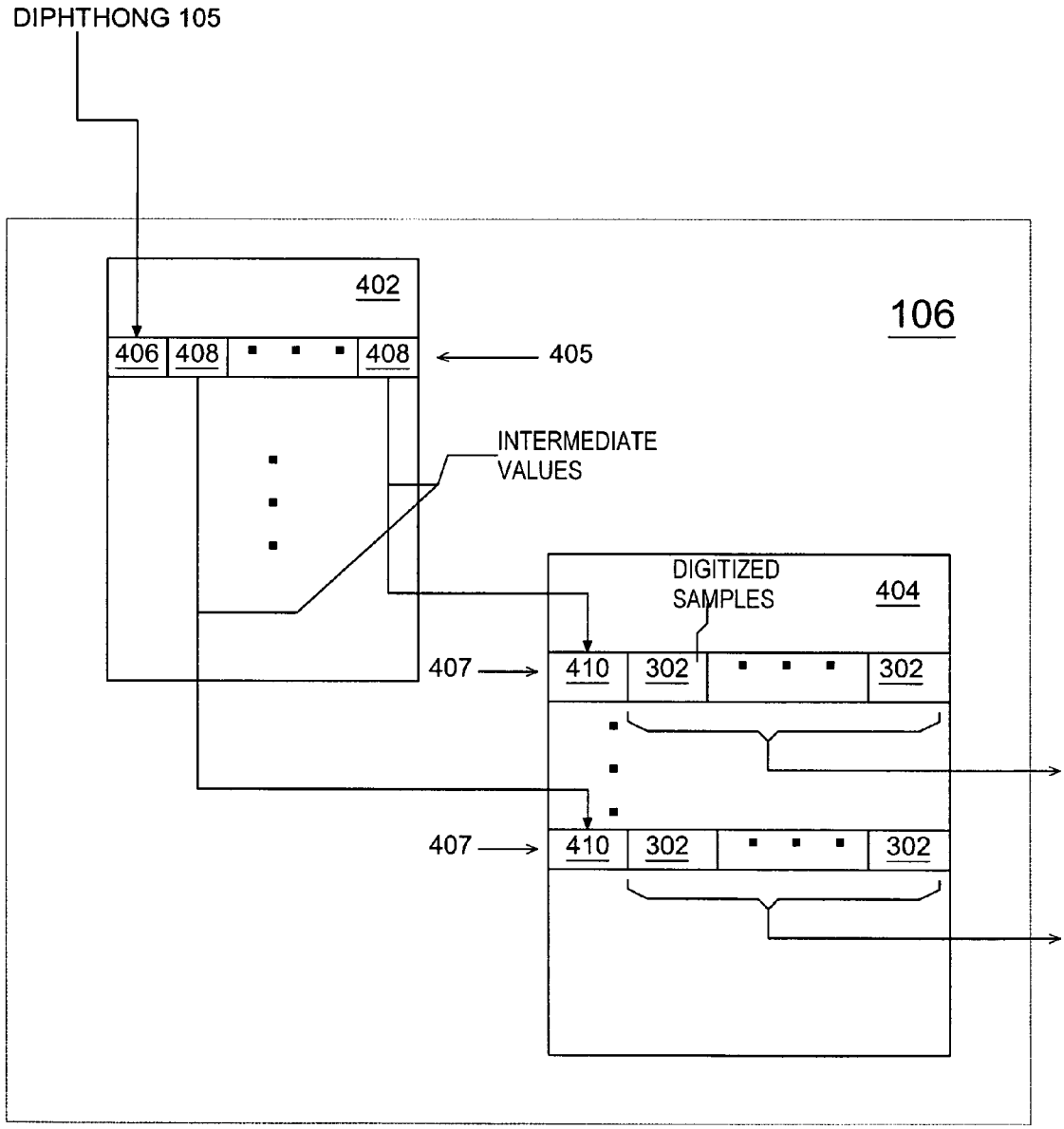
FIG. 4 is a block diagram of an audio dictionary according to one embodiment of the invention.

A second embodiment of multimedia dictionary 106 is depicted in FIG. 4. In this embodiment, multimedia dictionary 106 is implemented with a two level hierarchy that leverages the substantial overlap that may exist among the instantaneous samples comprising each diphthong. In this embodiment, dictionary 106 includes a first level dictionary block 402 and a second level dictionary block 404. The first level dictionary block includes a set of entries 405, each of which includes a tag 406 and a set of intermediate indexes 408. When a diphthong 105 is received from text converter 104, the diphthong is used to index tags 406 of first level dictionary block 402. The intermediate indexes 408 contained in the entry 405 that matches the received diphthong are retrieved. The retrieved intermediate indexes 408 then provide the indexes to second level dictionary block 404. Second level dictionary block 404 includes a set of entries 403, each containing a tag 410 and one or more digitized multimedia samples 302. The intermediate indexes 408 are used to index tags 410 in second level dictionary block 404 to retrieve the digitized samples 302 contained in the entry 407 with a tag 410 that matches the intermediate value 408. The two level hierarchy represented by the embodiment of dictionary 106 depicted in FIG. 4 consumes less memory space than the embodiment of dictionary 106 depicted FIG. 3 by eliminating the need to store redundant copies of the instantaneous digitized signals.

In one embodiment, the digitized samples that are combined to form the various diphthongs are created by sampling the speech of a particular speaker. Each diphthong could be captured by sampling at a high enough frequency to detect a series of instantaneous samples during the fraction of a second required to pronounce each diphthong. These instantaneous values are then stored in the multimedia dictionary 106. In one embodiment, a multimedia dictionary 106 created for a single speaker may be distributed to multiple users such that each user hears a common voice when the email is spoken. This embodiment of the invention provides a mechanism for "branding" a particular text-to-audio application such that users of the application will associate the audio voice with a particular vendor. Alternatively, the voice of a noted celebrity or other famous person could be widely distributed such that users would have their email or other text information read to them in the voice of their favorite personality. In one embodiment, system 100 may include multiple dictionaries 106, such as one dictionary 106 for each person from whom the user regularly receives email correspondence. Whether implemented in a single level or two level hierarchy, each of the dictionaries 106 in this embodiment would typically include a common set of tags corresponding to the received diphthongs 105. The digitized samples 302 produced corresponding to each diphthong, however, would vary from dictionary to dictionary. In this embodiment, the digitized samples 302 of a first dictionary, for example, would contain digitized representations of a first speaker's speech patterns while the digitized samples 302 of a second dictionary 106 would contain digitized representations of a second speaker's speech patterns. This embodiment of the invention could further include facilities for identifying the author or originator of text based information 101 and selecting the dictionary 106 corresponding to the identified author. One of the dictionaries 106 may be designated as the default dictionary that is used when a message is received from an author for whom system 100 does not have a customized dictionary.

In another embodiment, the digitized samples 302 stored in each dictionary 106 include video information as well as audio information. In this embodiment, a person would be video taped while reciting, for example, a standardized text designed to emphasize each recognized diphthong. In addition to recording the audio information comprising each diphthong, video information, such as the movement of the speaker's mouth, would also be sampled. This video information could be stored as part of the digitized sample 302 in dictionary 106. When a text message is later converted to its component diphthongs, the video and audio information contained in dictionary 106 would be reproduced to convey not only the voice of the message's author, but also a dynamic image of the author speaking the text information. In other words, the video information could be used to display an image of the speaker as he or she speaks. To provide further enhancement, the video information may be processed to include only the speaker's face or torso while the remainder of the video image is chroma-keyed or "blue screened." When the video information is later reproduced, a background video image could be integrated with the video information to produce the speaker's image in front of a pre-selected background image.

In the depicted embodiment of system 100, the digitized samples retrieved from multimedia dictionary 106 are forwarded to a DAC 108 that is connected to an audio output device in the form of speak 110. The digital to analog converter 108 may be integrated within a suitable audio adapter such as the audio adapter 216 depicted in FIG. 2. In an embodiment suitable for producing audio-video information, DAC 108 might be implemented as part of a multimedia decoder capable of parsing the video information from the audio information and =forwarding the respective information to the appropriate output device.

It will be apparent to those skilled in the art having the benefit of this disclosure that the present invention contemplates the conversion of text based information to multimedia information. It is understood that the form of the invention shown and described in the detailed description and the drawings are to be taken merely as presently preferred examples. It is intended that the following claims be interpreted broadly to embrace all the variations of the referred embodiments disclosed.

What is claimed is:

1. A system for generating multimedia information, comprising:

an interface suitable for receiving an email message;

a text converter configured to receive the email message and adapted to decompose text in the message into a set of diphthongs;

a first multimedia dictionary configured to receive diphthongs produced by the text converter and adapted to produce a set of digitized samples of multimedia information representative of the received diphthongs wherein the digitized samples are created by sampling the speech of a first speaker, and a second multimedia dictionary configured to receive diphthongs produced by the text converter and responsive thereto, to retrieve a set of digitized samples created by sampling the speech of a second speaker wherein the set of digitized samples retrieved from the first multimedia dictionary responsive to at least one diphthong differs from the set of digitized samples retrieved from the second multimedia dictionary responsive to the same at least one diphthong, and further wherein the system is configured to select between the first and second multimedia dictionaries responsive to determining an author of the text-based message.

2. A system for generating multimedia information, comprising:

an interface suitable for receiving an email message;

a text converter configured to receive the email message and adapted to decompose text in the message into a set of diphthongs;

a first multimedia dictionary configured to receive diphthongs produced by the text converter and adapted to produce a set of digitized samples of multimedia information representative of the received diphthongs wherein the digitized samples are created by sampling the speech of a first speaker, and a second multimedia dictionary configured to receive diphthongs produced by the text converter and responsive thereto, to retrieve a set of digitized samples created by sampling the speech of a second speaker wherein the set of digitized samples retrieved from the first multimedia dictionary responsive to at least one diphthong differs from the set of digitized samples retrieved from the second multimedia dictionary responsive to the same at least one diphthong and wherein the first multimedia dictionary is selected if the first speaker is the author of the text-based message.

* * * * *